US010807844B2

(12) United States Patent
Ooe

(10) Patent No.: US 10,807,844 B2
(45) Date of Patent: Oct. 20, 2020

(54) VERTICALLY MOVABLE WORKPIECE SUPPORT DEVICE

(71) Applicant: Daifuku Co., Ltd., Osaka (JP)

(72) Inventor: Masahiro Ooe, Shiga (JP)

(73) Assignee: Daifuku Co., Ltd. (JP)

( * ) Notice: Subject to any disclaimer, the term of this patent is extended or adjusted under 35 U.S.C. 154(b) by 191 days.

(21) Appl. No.: 16/058,481

(22) Filed: Aug. 8, 2018

(65) Prior Publication Data

US 2019/0047832 A1 Feb. 14, 2019

(30) Foreign Application Priority Data

Aug. 8, 2017 (JP) ..... 2017-153074

(51) Int. Cl.

| | |
|---|---|
| ***B66F 3/06*** | (2006.01) |
| ***B66F 7/12*** | (2006.01) |
| ***B66F 3/22*** | (2006.01) |
| ***B66F 7/06*** | (2006.01) |

(52) U.S. Cl.

CPC ..... *B66F 3/06* (2013.01); *B66F 3/22* (2013.01); *B66F 7/065* (2013.01); *B66F 7/12* (2013.01); *B66F 2700/03* (2013.01)

(58) Field of Classification Search

CPC ..... B66F 3/06; B66F 3/22; B66F 7/06; B66F 7/12; B66F 7/065; B66F 2700/03

USPC ..... 75/575, 577 R; 254/95

See application file for complete search history.

(56) References Cited

U.S. PATENT DOCUMENTS 486,389 A * 11/1892 Wright ..... B66F 3/02 254/95

7,404,344 B2 * 7/2008 Erdloff ..... G05G 1/08 74/575

FOREIGN PATENT DOCUMENTS

JP 2017039552 A 2/2017

* cited by examiner

*Primary Examiner* — Monica S Carter
*Assistant Examiner* — Alberto Saenz
(74) *Attorney, Agent, or Firm* — St. Onge Steward Johnston & Reens LLC

(57) ABSTRACT

A vertically movable workpiece support device has a ratchet wheel with a larger diameter than the outer diameter of a driving sprocket wheel and is concentrically attached to an end surface of a boss portion in the driving sprocket wheel. A pair of left and right bearing members are provided side by side, on a side on which the free end side of a drive chain is horizontally extended with respect to the driving sprocket wheel, so as to sandwich a horizontally extending path section of the drive chain. A movable pawl is pivotally supported between the pair of left and right bearing members and engages with the ratchet wheel to block the rotation of the ratchet wheel caused by the movement of the drive chain when the workpiece support base is lowered. An actuator switches the movable pawl to a non-action position with respect to the ratchet wheel.

2 Claims, 11 Drawing Sheets

VERTICALLY MOVABLE WORKPIECE SUPPORT DEVICE

FIELD OF THE INVENTION

The present invention relates to a vertically movable workpiece support device in which a raising/lowering drive means that drives a workpiece support base supported so as to be parallelly and vertically movable to raise and lower the workpiece support base is formed with a drive chain that is bendable to only one side and a driving sprocket wheel that engages with the drive chain.

BACKGROUND OF THE INVENTION

More specifically, a vertically movable workpiece support device has been known which is configured such that the drive chain supports the workpiece support base in a vertically linear path section extending from one end portion coupled to the workpiece support base to an intermediate portion engaging with the driving sprocket wheel and in which a part of the drive chain on the side of a free end from the driving sprocket wheel is extended horizontally through the lower side of the driving sprocket wheel. In the vertically movable workpiece support device described above, the vertically linear path section of the drive chain butts against the workpiece support base raised to a predetermined height such that the workpiece support base is held. However, at this time, if a braking means included in a motor for rotationally driving the driving sprocket wheel no longer functions due to failure, and thus the driving sprocket wheel becomes free, there is a possibility that, with the reverse rotation of the driving sprocket wheel and the lowering of the drive chain, impact drop of the workpiece support base is caused by gravity. In order to solve the problem described above, as described in Japanese Published Unexamined Patent Application No. 2017-039552 (Patent Literature 1), a safety mechanism is provided that is formed with a workpiece support base lowering-restraining mechanism which restrains, with a ratchet gear and a movable pawl that freely engages and disengages with respect to the ratchet gear, the movement at the time of lowering of the workpiece support base in a parallel link mechanism supporting the workpiece support base so as to be parallelly and vertically movable, and an actuator for switching the movable pawl to a non-cation posture in advance such that the workpiece support base lowering-restraining mechanism does not function at the time of normal lowering.

SUMMARY OF THE INVENTION

The above-described safety mechanism described in Japanese Published Unexamined Patent Application No. 2017-039552 (Patent Literature 1) is configured such that the lateral movement, at the time of the lowering of the workpiece support base, of a movable bearing which supports a movable fulcrum shaft on the side of a supporting frame in the parallel link mechanism supporting the workpiece support base so as to be parallelly and vertically movable and which is freely moved forward and backward is blocked by the ratchet gear laid along the lateral movement path of the movable bearing and the movable pawl pivotally supported to the movable bearing. Therefore, it is necessary not only to provide a long ratchet gear but also to attach the actuator for switching the movable pawl in advance to the non-action posture to the movable bearing which pivotally supports the movable pawl. Consequently, disadvantageously, a cost required for an energizing system for the actuator is increased, the overall cost is increased and the occupied space is enlarged.

The present invention proposes a vertically movable workpiece support device which can solve the conventional problem as described above, and for ease of understanding of a relationship with embodiments which will be described later, the vertically movable workpiece support device according to the present invention will be shown with reference signs which are used in the description of the embodiments and which are placed in parentheses. In the vertically movable workpiece support device which includes a raising/lowering drive means (21) that drives a workpiece support base (3) supported so as to be parallelly and vertically movable to raise and lower the workpiece support base (3) and in which the raising/lowering drive means (21) is formed with a drive chain (22*a*) that is bendable to only one side and a driving sprocket wheel (23*a*) that engages with the drive chain (22*a*), in which the drive chain (22*a*) supports the workpiece support base (3) in a vertically linear path section that is extended from one end portion coupled to the workpiece support base (3) to an intermediate portion engaging with the driving sprocket wheel (23*a*) and in which a part of the drive chain (22*a*) on a free end side from the driving sprocket wheel (23*a*) is extended horizontally through a lower side of the driving sprocket wheel (23*a*), a ratchet wheel (38) which has a larger diameter than an outer diameter of the driving sprocket wheel (23*a*) is concentrically attached to an outer side of the driving sprocket wheel (23*a*), a pair of left and right bearing members (41*a*, 41*b*) are provided side by side, on a side on which the free end side of the drive chain (22*a*) is horizontally extended with respect to the driving sprocket wheel (23*a*), so as to sandwich a horizontally extending path section of the drive chain (22*a*), a movable pawl (39) which engages with the ratchet wheel (38) so as to block the rotation of the ratchet wheel (38) caused by a movement of the drive chain (22*a*) when the workpiece support base (3) is lowered is pivotally supported between the pair of left and right bearing members (41*a*, 41*b*), and an actuator (40) which switches the movable pawl (39) to a non-action position with respect to the ratchet wheel (38) is additionally provided.

According to the configuration of the present invention described above, at least when the workpiece support base is lowered, by switching the movable pawl in advance to a retraction position by the actuator, the driving sprocket wheel can be rotationally driven by a motor in any one of the forward and reverse directions, with the result that the workpiece support base can be pushed upward by the drive chain to be raised or can be lowered at a constant speed by gravity. When the workpiece support base is stopped at a predetermined height, as conventionally, by a braking mechanism included in the motor or the like, the driving sprocket wheel can be brought into a state where the driving sprocket wheel is prevented from being rotated whereas except when the workpiece support base is actively lowered, the movable pawl is returned by the actuator from a non-action position to an action position, and thus by the movable pawl, via the ratchet wheel, the rotation of the driving sprocket wheel in the lowering direction of the workpiece support base can be prevented. By controlling the actuator in this way, under conditions in which the raised or lowered workpiece support base is stopped at an intended height, even if the braking mechanism included in the motor or the like fails such that the driving sprocket wheel becomes free, the movable pawl engages with the ratchet wheel integrated with the driving sprocket wheel, and thus the rotation of the driving sprocket wheel in the lowering direction of the workpiece support base is blocked, with the result that it is possible to prevent an accident in which the workpiece support base drops violently by gravity.

By the action described above, it is possible to prevent an unintended accidental drop of the workpiece support base, and according to the configuration of the present invention described above, as compared with a conventional configuration where a ratchet gear and a movable pawl engaging therewith are used, it is possible to implement the present invention as a compact mechanism in which the ratchet wheel and the movable pawl engaging therewith are used and which require a small occupied space, with the result that it is possible to expect significant effects such as:

1. Since the pivotally-supporting structure of the driving sprocket wheel can be utilized as it is to pivotally support the ratchet wheel, as compared with a case where a ratchet wheel is pivotally supported separately from a raising/lowering driving sprocket wheel, the number of components is reduced, and it is thereby possible to implement at low cost.

A recessed corner side space of the drive chain which is moved in the shape of an arc in a range of approximately 90 degrees around the driving sprocket wheel, that is, a recessed corner side space of the drive chain which is normally difficult to utilize as a space to arrange other members therewithin is utilized, and it is thereby possible to form an anti-drop means in a compact manner.

3. Since the ratchet wheel is made to have a large diameter with respect to the driving sprocket wheel which has a relatively small diameter in terms of structure, it is easy to concentrically adhere and fix the ratchet wheel to an end surface of the boss portion of the raising/lowering driving sprocket wheel. As a matter of course, by the ratchet wheel having a large diameter, it is possible to reduce a load which is received by the pawl portion and the movable pawl of the ratchet wheel when the dropping is blocked, and by increasing the number of pawls around the ratchet wheel, it is also easy to reduce the amount of lowering of the workpiece support base until the dropping is blocked.

In a case where the present invention is implemented, specifically, it can be configured such that, an upper end portion of the movable pawl (39) is pivotally supported to an upper position of a circumferential edge of the height of the axis center of the ratchet wheel (38), a part from the upper end portion to a lower end pawl portion (39*a*) positioned therebelow is formed in a wide width shape that is expanded to a side away from the ratchet wheel (38), by gravity acting on this wide width shaped part (39*b*), a rotation force in such a direction that the lower end pawl portion (39*a*) engages with a circumferential edge of the ratchet wheel (38) is applied to the movable pawl (39), an engagement hole (39*d*) which is loosely fitted into a drive pin (40*b*) attached to a tip end of a drawing-in shaft (40*a*) of the actuator (40) is provided in the wide width shaped part (39*b*) of the movable pawl (39), the engagement hole (39*d*) is formed so as to have such a size that an engagement/disengagement swing movement of the movable pawl (39) caused by the rotation of the ratchet wheel (38) when the workpiece support base (3) is raised is not transmitted to the drive pin (40*b*), and when the drawing-in shaft (40*a*) of the actuator (40) is made to perform a drawing-in operation, the movable pawl (39) is held in a state where the movable pawl (39) is disengaged from the ratchet wheel (38) via the drive pin (40*b*) and the engagement hole (39*d*).

According to the configuration described above, since the movable pawl itself has a shape having a rotation force in such a direction so as to engage with the ratchet wheel by gravity, without especially using an additional spring which biases the movable pawl in such an orientation that the movable pawl engages with the ratchet wheel, the present invention can be implemented, with the result that the number of components is reduced, and it is thereby possible to implement the present invention at low cost. And, the wide width shaped part of the movable pawl for obtaining such effects provides a formation region of the engagement hole with which the drive pin on the side of the actuator engages, and thus it is also easy to form the engagement hole into such a size that the engagement/disengagement swing movement of the movable pawl caused by the rotation of the ratchet wheel when the workpiece support base is raised is not transmitted to the drive pin. That is, only when the workpiece support base is lowered, by switching the movable pawl to the retraction position in advance at which the movable pawl does not engage with the ratchet wheel, and in a state where the movable pawl can always engage with the ratchet wheel under any other condition except the above, even when an abnormality occurs in which the driving sprocket wheel becomes free while the workpiece support base is being raised or the like, without depending on a signal obtained from a special sensor, it is possible to automatically operate the movable pawl such that the driving sprocket wheel is stopped via the ratchet wheel to restrain the dropping of the workpiece support base. Moreover, when the workpiece support base is normally raised, the engagement/disengagement swing movement of the movable pawl is not transmitted to the drawing-in shaft of the actuator, and thus the side of the actuator is not influenced by adversely effects.

In a case where the workpiece support base is pushed upward by the drive chain and is driven to be raised, even if the movable pawl is not switched by the actuator to the retraction position at which the movable pawl does not engage with the ratchet wheel, the movable pawl can ride on the pawl of the ratchet wheel so as to pass through the pawl as a result of the rotation of the ratchet wheel that is rotated integrally with the driving sprocket wheel. However, the swing operation of the movable pawl at this time causes intermittent collision between the metallic movable pawl and the metallic pawls of the ratchet wheel, and thereby noise is generated. In order to solve the problem described above, the following structure can be adopted. In the ratchet wheel (38), a second ratchet wheel (44) which is rotated integrally with the ratchet wheel (38), which has the same number of pawls and which is made of a resin is arranged concentrically and side by side, and the second ratchet wheel (44) includes pawls (44*a*) which are tall in height such that the engagement of the movable pawl (39) between pawls (38*c*) of the ratchet wheel (38) is allowed but that when the movable pawl (39) rides on the pawl (38*c*) of the ratchet wheel (38) so as to pass through the pawl (38*c*), the movable pawl (39) is floated up from the pawl (38*c*) of the ratchet wheel (38). According to this configuration, in a case where the workpiece support base is pushed upward by the drive chain and is driven to be raised as described above, even if the movable pawl swings due to the rotation of the ratchet wheel, the movable pawl collides with the pawls of the second ratchet wheel made of the resin, and it is thereby possible to avoid the generation of noise caused by the repeated collision with the metallic pawls of the ratchet wheel.

DETAILED DESCRIPTION OF THE INVENTION

A vertically movable workpiece support device according to the present invention will be described below with reference to drawings. As shown in FIGS. 1 to 5, in the workpiece support device, on a horizontal frame 1, via a parallel link mechanism 2, a workpiece support base 3 is supported so as to be parallelly and vertically movable while keeping a horizontal posture. The parallel link mechanism 2 uses a pair of left and right crosslinks 4A and 4B, and the respective crosslinks 4A and 4B have a laterally symmetrical structure and are respectively formed by overlapping two link units 5*a* and 5*b* of the same length and are pivotally supported with and integrated by a support shaft 6 so as to freely open and close at a center position.

The lower ends of the pair of left and right link units 5*a* positioned on the inner side of both the crosslinks 4A and 4B are pivotally supported with mutually-concentric horizontal support shafts 8*a* and 8*b* to a pair of left and right fixed bearings 7*a* and 7*b* which are additionally provided on a rear end portion of the horizontal frame 1, and the upper ends of both the link units 5*a* are pivotally supported with mutually-concentric horizontal support shafts 11*a* and 11*b* to movable bearings 10*a* and 10*b* which engage with guide rails 9*a* and 9*b* in a forward/backward direction laid in parallel to each other to the lower side of a front end side of the workpiece support base 3 so as to freely slide horizontally forward and backward thereon. The upper ends of the pair of left and right link units 5*b* positioned on the outer side of both the crosslinks 4A and 4B are pivotally supported with mutually-concentric horizontal support shafts 13*a* and 13*b* to a pair of left and right fixed bearings 12*a* and 12*b* which are additionally provided on the lower side of a rear end portion of the workpiece support base 3, and the lower ends of both the link units 5*b* are pivotally supported with mutually-concentric horizontal support shafts 16*a* and 16*b* to movable bearings 15*a* and 15*b* which engage with guide rails 14*a* and 14*b* in the forward/backward direction laid in parallel to each other on the upper end side of the horizontal frame 1 so as to freely slide horizontally forward and backward thereon.

Figure 1:
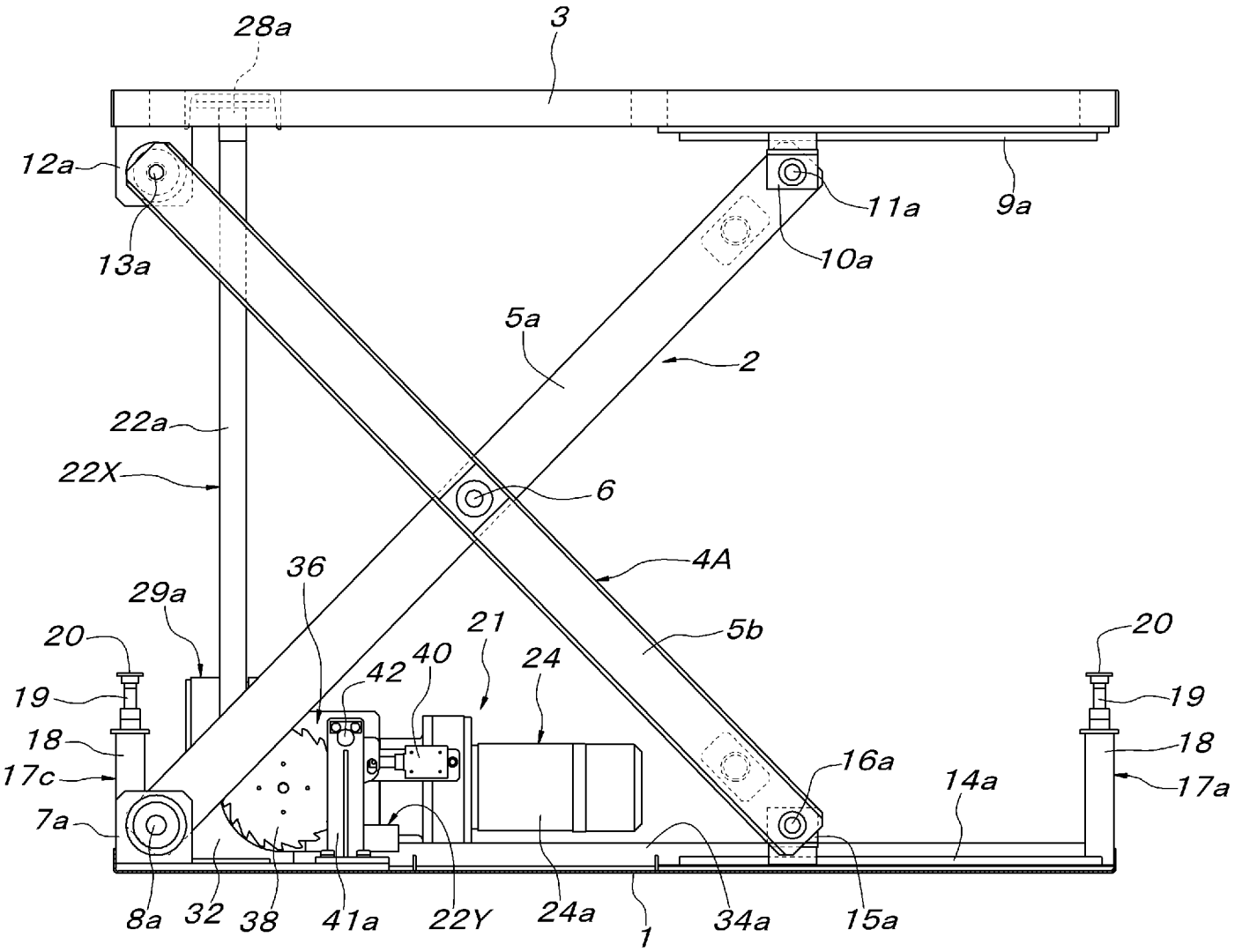
FIG. 1 is side view in a state where a workpiece support base is raised to a raising limit height.
Figure 2:
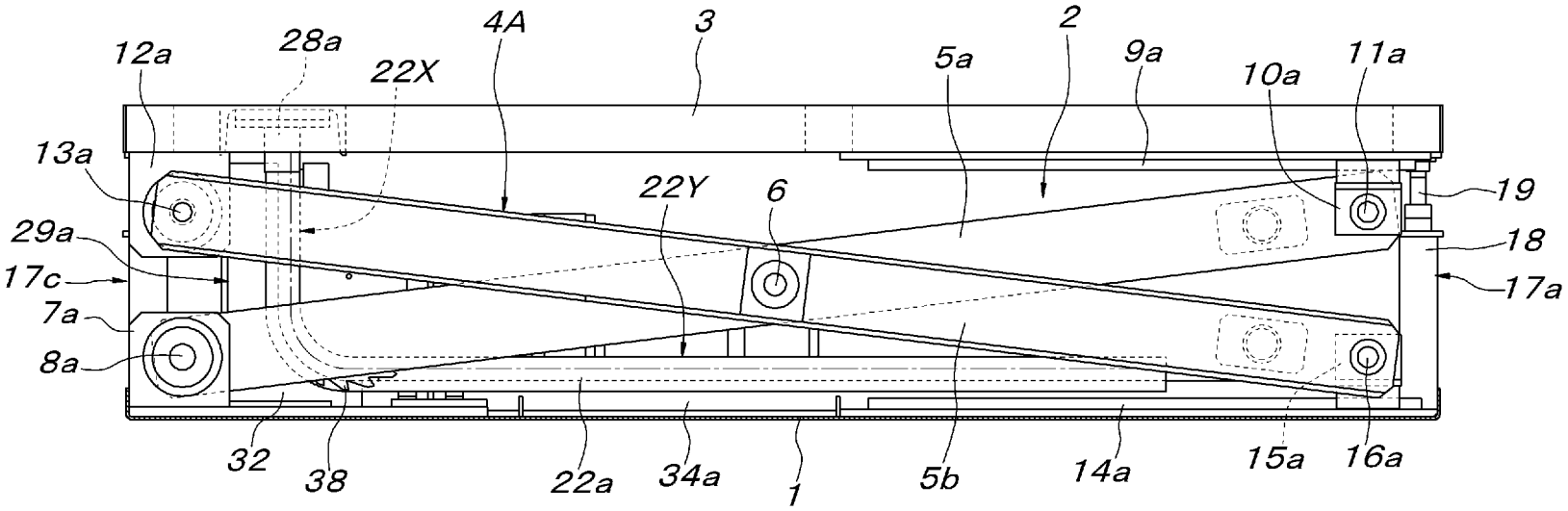
FIG. 2 is side view in a state where the workpiece support base is lowered to a lowering limit height.
Figure 3:
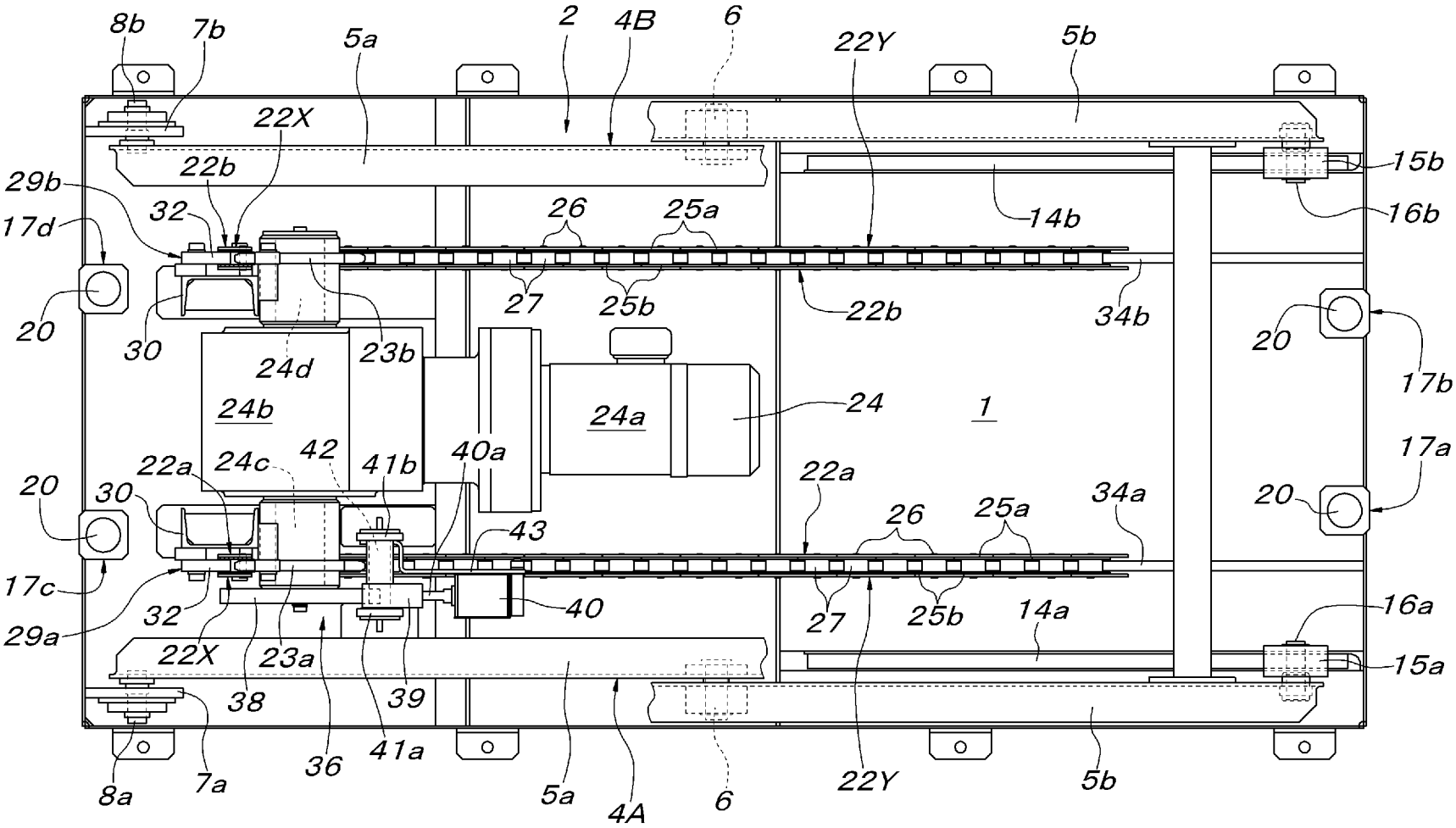
FIG. 3 is a plan view of a lower half on the side of the workpiece support base of FIG. 2
Figure 4:
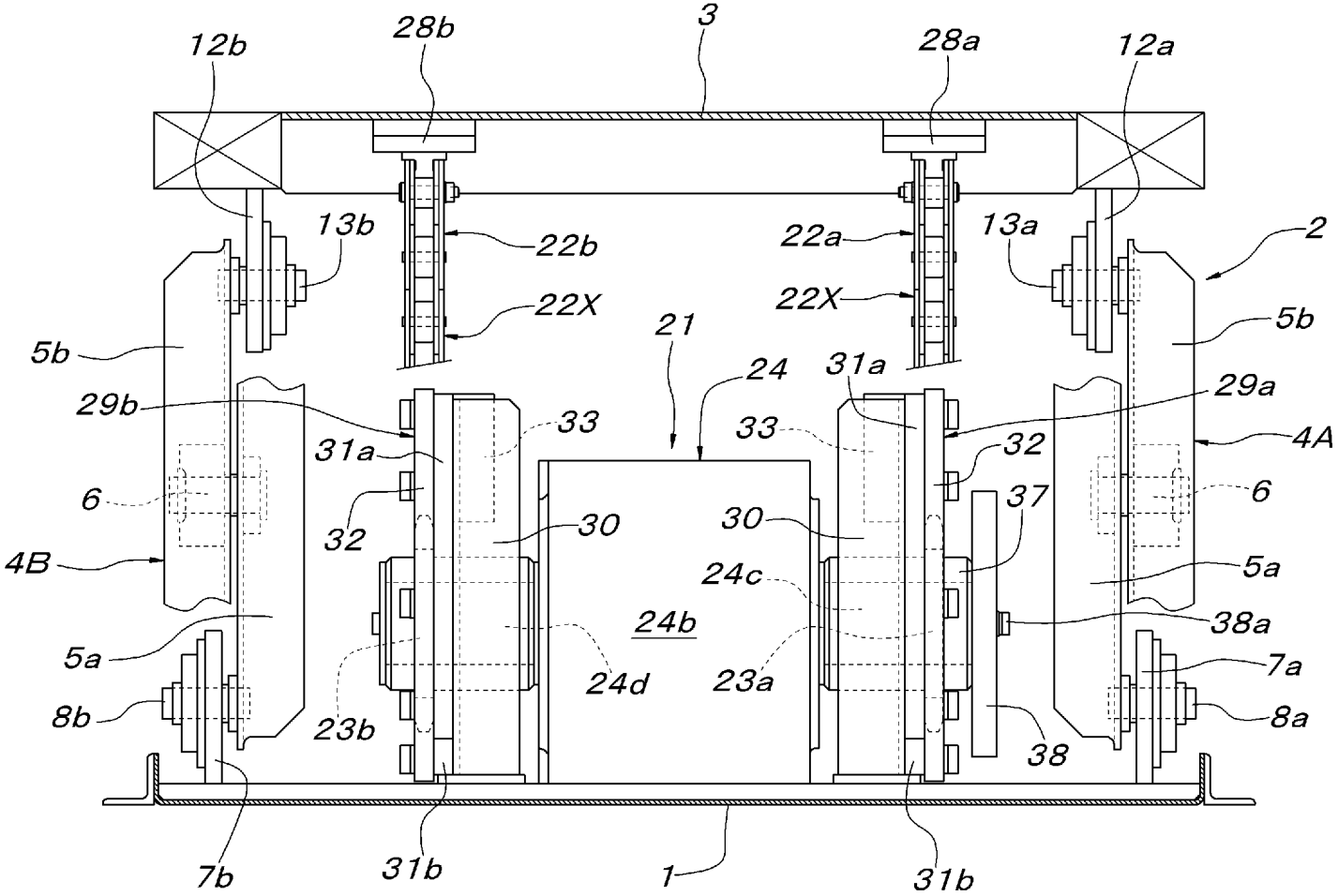
FIG. 4 is a vertical cross-sectional elevational view when viewed from the side of a fixed support shaft in a parallel link mechanism in a state where the workpiece support base is at an intermediate height.
Figure 5:
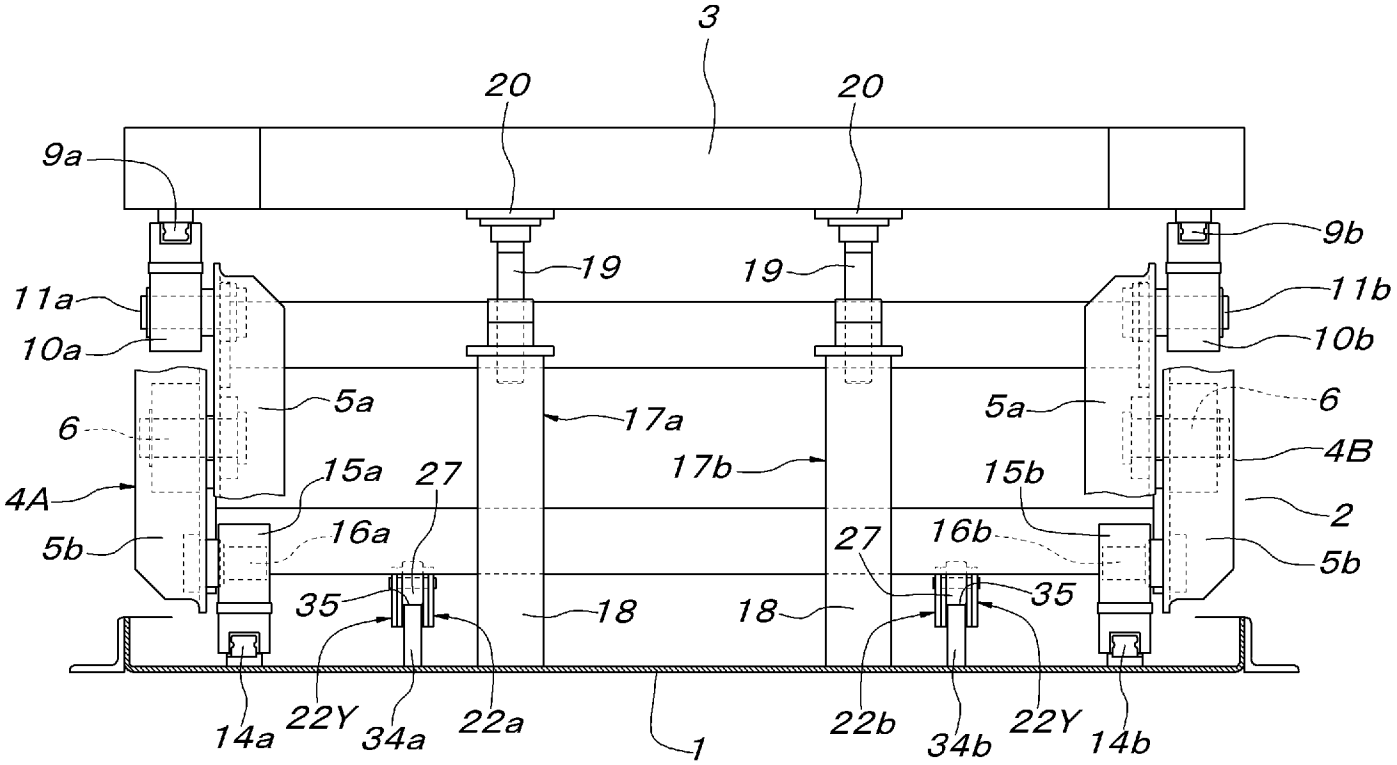
FIG. 5 is a vertical cross-sectional elevational view when viewed from the side of a movable support shaft in the parallel link mechanism in a state where the workpiece support base is at the lowering limit height.

The workpiece support base 3 supported with the parallel link mechanism 2 as described above can be moved parallelly and vertically between a raising limit position shown in FIG. 1 and a lowering limit position shown in FIG. 2 while keeping a horizontal posture, and when the workpiece support base 3 is present in the lowering limit position shown in FIG. 2, four support members 17*a* to 17*d* which individually support two left and right parts of the front end portion and two left and right parts of the rear end portion of the workpiece support base 3 are provided so as to stand on the horizontal frame 1. The respective support members 17*a* to 17*d* support a receiving board 20 on the upper ends of column main bodies 18 via screw shafts 19 such that the height can be freely adjusted.

Figure 7:
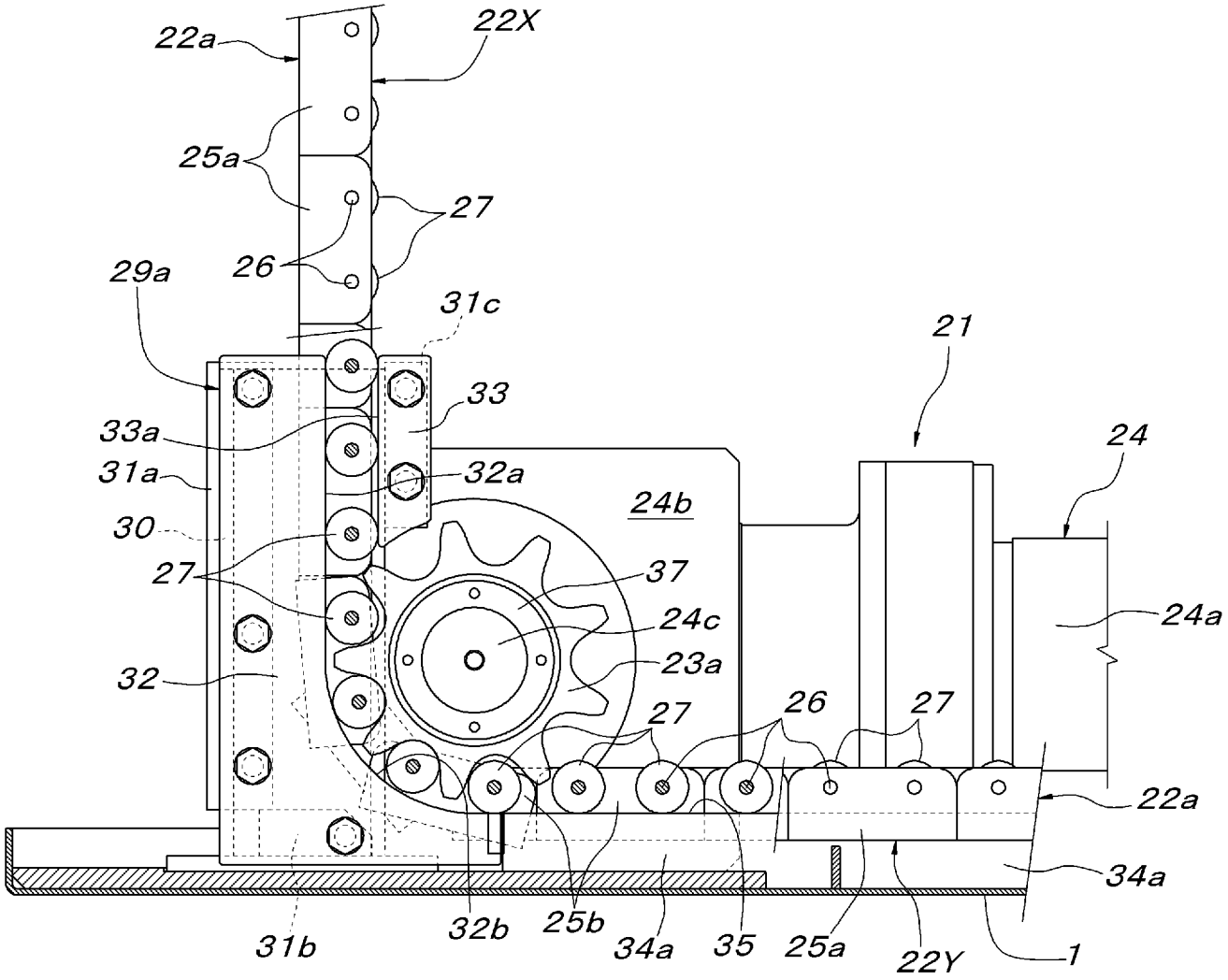
FIG. 7 is a vertical cross-sectional side view showing a state where the anti-drop means according to the present invention is removed from FIG. 6.

A raising/lowering drive means 21 which drives the workpiece support base 3 to raise and lower the workpiece support base 3 is additionally provided. The raising/lowering drive means 21 is formed with a pair of left and right drive chains 22*a* and 22*b*, a pair of left and right driving sprocket wheels 23*a* and 23*b* which engage with the respective drive chains 22*a* and 22*b*, and a speed reducer equipped motor 24 which synchronously drives both the driving sprocket wheels 23*a* and 23*b*. As shown in FIG. 7, the drive chains 22*a* and 22*b* are formed with roller chains in which coupling pins 26 that couple a pair of left and right outer link plates 25*a* and a pair of left and right inner link plates 25*b* in a position displaced to one side and that are arranged at regular intervals are made to support rollers 27 between the inner link plates 25*b* so as to feely idle the rollers 27 and which are freely bendable to one side as conventionally known.

In the pair of left and right drive chains 22*a* and 22*b* configured as described above, one ends thereof are coupled via chain end portion coupling tools 28*a* and 28*b* to the lower side on a rear end side of the workpiece support base 3 such that the bendable sides of the drive chains 22*a* and 22*b*, that is, the side on which the rollers 27 protrude is directed so as to be positioned on the front end side of the workpiece support base 3. The drive chains 22*a* and 22*b* are suspended vertically downward from the workpiece support base 3, are engaged with the rear side of the pair of left and right driving sprocket wheels 23*a* and 23*b* pivotally supported on the rear end side on the horizontal frame 1 in a mutually concentric manner, and thereafter extended horizontally forward through the lower side of the driving sprocket wheels 23*a* and 23*b*. That is, in the drive chains 22*a* and 22*b*, between the workpiece support base 3 and the driving sprocket wheels 23*a* and 23*b* a vertically linear path section 22X which supports the workpiece support base 3 and a horizontally extending path section 22Y which is extended horizontally forward from the lower side of the driving sprocket wheels 23*a* and 23*b* are formed. In the speed reducer equipped motor 24, a speed reducer 24*b* is integrally coupled to the front end side of a motor main body 24*a* directed in the forward/backward direction, the speed reducer equipped motor 24 includes an electromagnetic brake, the speed reducer 24*b* is installed on the horizontal frame 1 so as to be positioned at an intermediate part of the pair of left and right driving sprocket wheels 23*a* and 23*b* and the driving sprocket wheels 23*a* and 23*b* are attached to a pair of left and right output shafts 24*c* and 24*d* which protrude from the speed reducer 24*b* to both the left and right sides in a mutually concentric manner. Therefore, by energizing the motor main body 24*a* so as to be operated, the electromagnetic brake is released, and it is possible to synchronously drive the pair of left and right driving sprocket wheels 23*a* and 23*b* in the same direction at the same speed.

Figure 6:
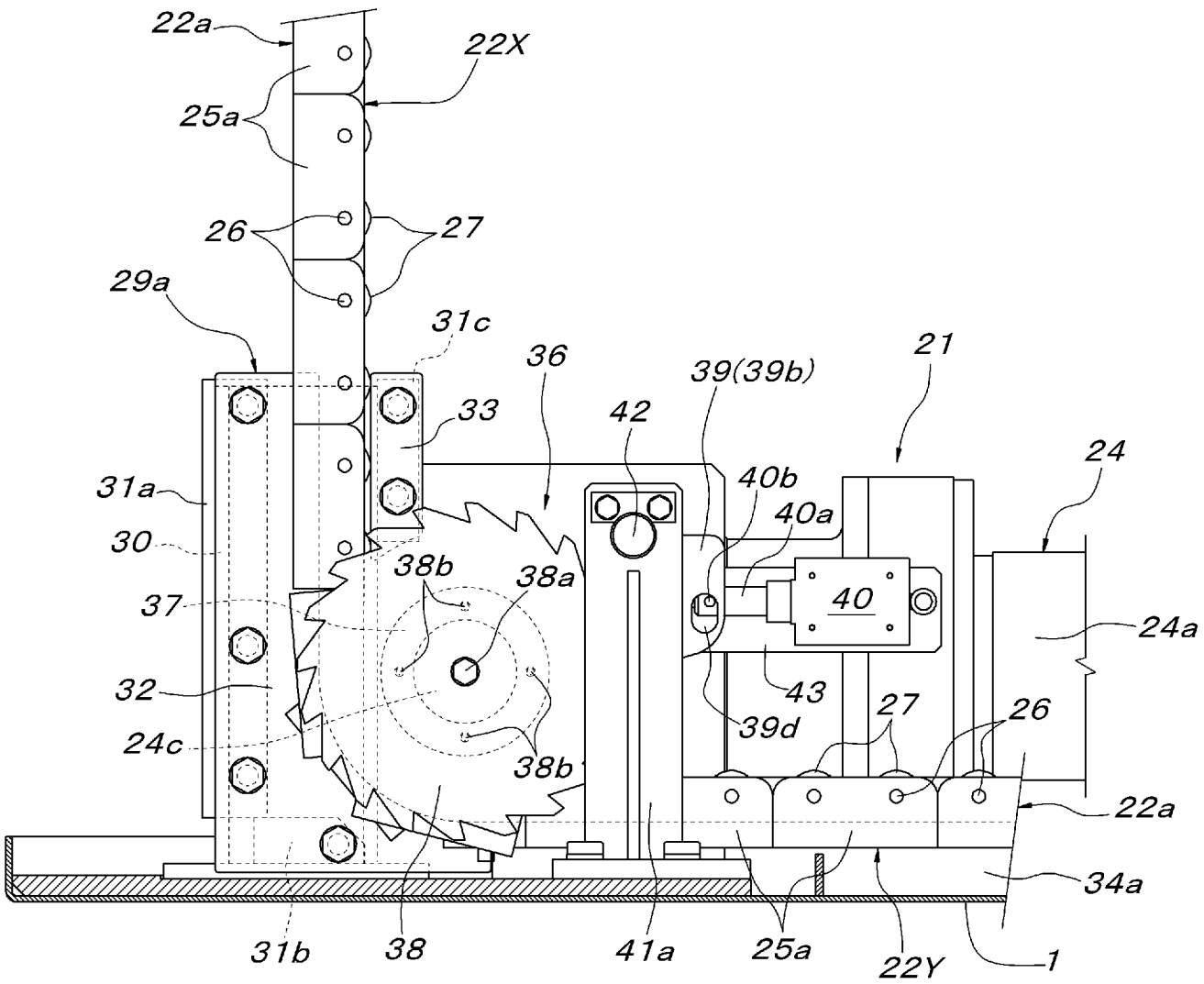
FIG. 6 is a side view of a main part in a state where an anti-drop means according to the present invention is attached.
Figure 8:
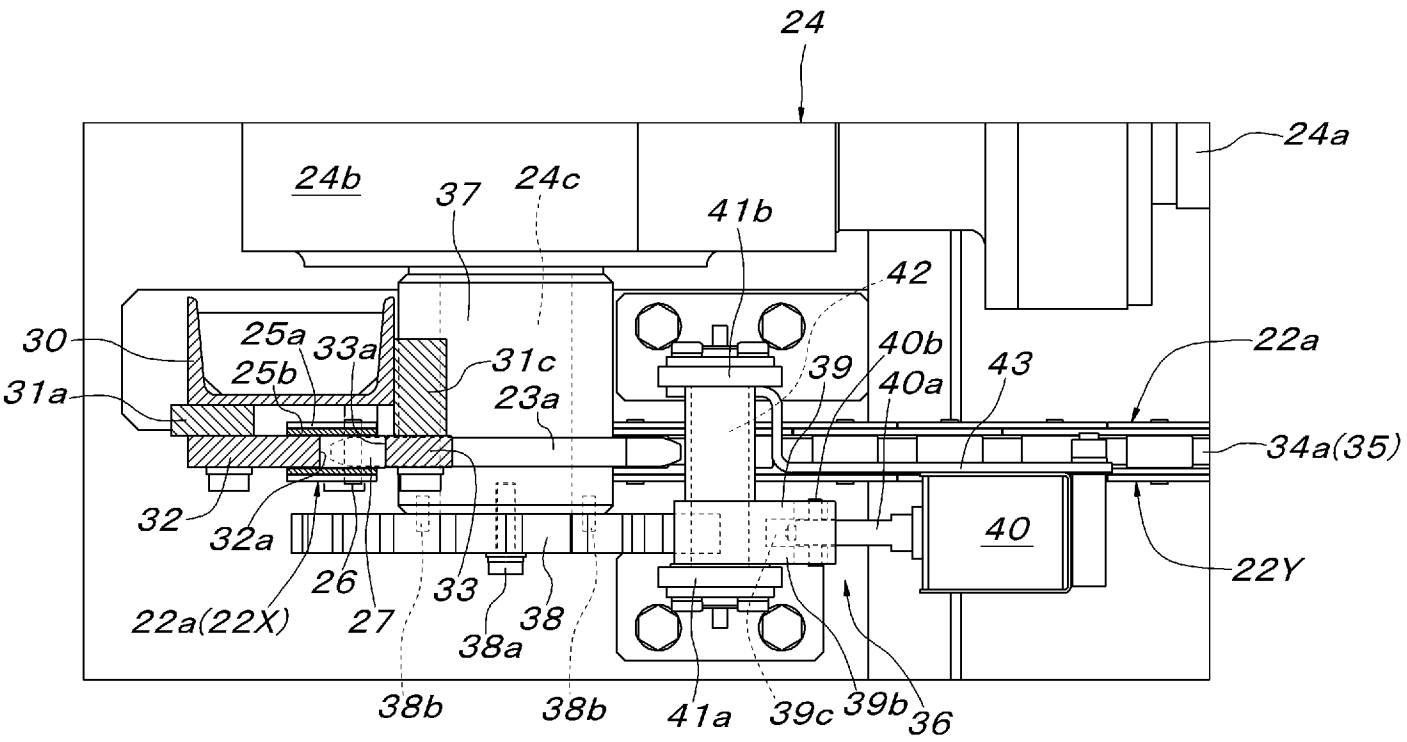
FIG. 8 is a partial horizontal cross-sectional plan view of FIG. 6.

In the pair of left and right driving sprocket wheels 23*a* and 23*b*, chain guide means 29*a* and 29*b* for guiding the respective drive chains 22*a* and 22*b* are additionally provided. As shown in FIGS. 6 to 8, the chain guide means 29*a* and 29*b* are attached via spacers 31*a* and 31*b* to the outer sides of column members 30 which are provided so as to stand on the horizontal frame 1, and are formed with an inner roller guide plate 32 which enters between the inner link plates 25*b* of the drive chains 22*a* and 22*b* from behind and guides the rollers 27 so as to freely roll the rollers 27, and an outer roller guide plate 33 which is attached to a support member 31*c* attached to the front sides of the column member 30 and guides the rollers 27 of the drive chains 22*a* and 22*b* so as to freely roll the rollers 27. The inner roller guide plate 32 includes a linear guide side 32*a* which guides the rollers 27 in a vertically linear path section positioned higher than the driving sprocket wheels 23*a* and 23*b* of the drive chains 22*a* and 22*b*, and an arc-shaped guide side 32*b* which guides the rollers 27 of the drive chains 22*a* and 22*b* which are turned along a range of approximately 90 degrees of the driving sprocket wheels 23*a* and 23*b*. The outer roller guide plate 33 includes a linear guide side 33*a* which guides the rollers 27 at a position higher than the driving sprocket wheels 23*a* and 23*b* and between the linear guide side 33*a* and the linear guide side 32*a* of the inner roller guide plate 32.

Furthermore, chain guide rails 34*a* and 34*b* which support and guide the horizontally extending path sections 22Y of the respective drive chains 22*a* and 22*b* that are extended horizontally forward from the lower side of the driving sprocket wheels 23*a* and 23*b* are laid on the horizontal frame 1. The chain guide rails 34*a* and 34*b* include a horizontal linear guide side 35 which enters between the inner link plates 25*b* of the drive chains 22*a* and 22*b* from below and which supports and guides the rollers 27 of the drive chains 22*a* and 22*b* so as to freely roll the rollers 27, and the beginning end portion (rear end portion) thereof is connected to the free end of the arc-shaped guide side 32*b* of the inner roller guide plate 32 in the chain guide means 29*a* and 29*b*.

In the workpiece support device configured as described above, an anti-drop safety mechanism 36 for the workpiece support base 3 is provided. The anti-drop safety mechanism 36 is additionally provided in the driving sprocket wheel 23*a*, a pair of left and right driving sprocket wheels 23*a* and 23*b* which form the raising/lowering drive means 21 of the workpiece support base 3, and is formed with a ratchet wheel 38 which is concentrically attached to the outer side of the driving sprocket wheel 23*a*, a movable pawl 39 which engages with the ratchet wheel 38, and an actuator 40 which operates the movable pawl 39. Although the ratchet wheel 38 is attached with one bolt 38*a* screwed to a screw hole provided in the center of the outer end surface of the output shaft 24*c* in the speed reducer 24*b* to which the driving sprocket wheel 23*a* is attached, in order to prevent the ratchet wheel 38 from being rotated around the bolt 38*a*, a plurality of anti-rotation pins 38*b* in a circumferential direction are used which are fitted in parallel to the axis center between both a boss portion 37 of the driving sprocket wheel 23*a* that is externally fitted and keyed to the output shaft 24*c* and the ratchet wheel 38.

Figure 9A:
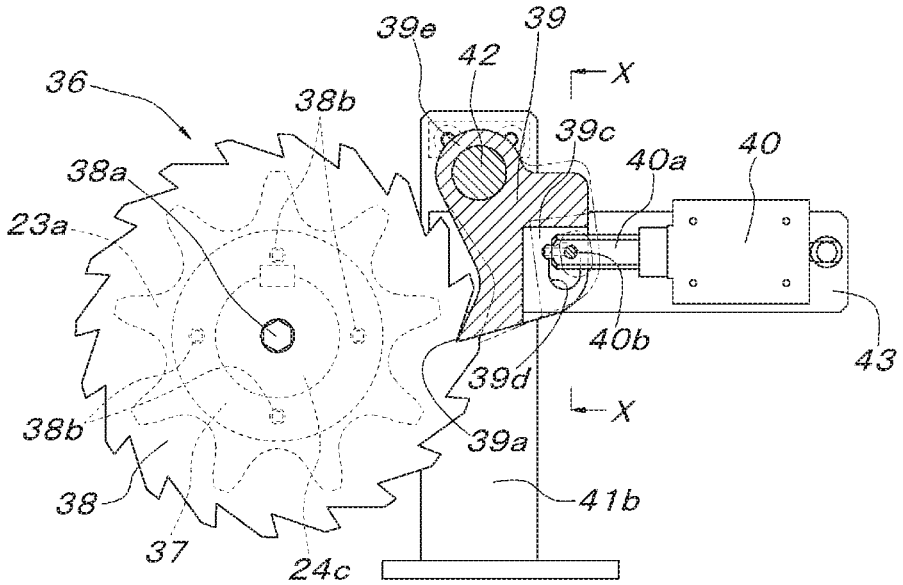
FIG. 9A is a partial vertical cross-sectional side view showing the anti-drop means according to the present invention.

In the movable pawl 39, an upper end portion 39*e* thereof is pivotally supported with a support shaft 42 which is placed laterally in a horizontal direction between upper end portions of a pair of left and right bearing plates 41*a* and 41*b* provided to stand on the horizontal frame 1 so as to sandwich, from both the left and right sides, the rear sides (the sides on which the drive chains 22*a* and 22*b* are extended horizontally from the lower side of the driving sprocket wheels 23*a* and 23*b*) of both the driving sprocket wheel 23*a* and the ratchet wheel 38, and a lower end pawl portion 39*a* positioned directly below the support shaft 42 engages between rear side pawls at the height of the axis center of the ratchet wheel 38. The lower end pawl portion 39*a* of the movable pawl 39 engages between the rear side pawls at the height of the axis center of the ratchet wheel 38, and thereby the rotation (the counterclockwise rotation of the ratchet wheel 38 shown in FIG. 9A) of the ratchet wheel 38 (the driving sprocket wheel 23*a*) when the workpiece support base 3 is lowered is blocked. The movable pawl 39 has an expanded part 39*b* having a wide width. The expanded part 39*b* is located between the upper end portion 39*e* pivotally supported with the support shaft 42 and the lower end pawl portion 39*a* directly therebelow. The expanded part 39*b* is expanded forward away from the ratchet wheel 38, and it is configured such that, by gravity acting on the expanded part 39*b*, a rotation force is exerted on the movable pawl 39 in such a direction that the lower end pawl portion 39*a* is biased toward and moved close to the side of the ratchet wheel 38 such that the lower end pawl portion 39*a* engages the ratchet wheel.

The actuator 40 is adhered so as to be fixed to an inner side surface in the vicinity of the upper end of the bearing plate 41*b*, of the pair of left and right bearing plates 41*a* and 41*b*, on the inner side of the driving sprocket wheel 23*a*, and is attached horizontally to the outer side surface of an attachment plate 43 which is extended forward away from the driving sprocket wheel 23*a*, and a drawing-in shaft 40*a* which protrudes forward is coupled to the movable pawl 39 in an interlocking manner. That is, in the wide width shaped part 39*b* of the movable pawl 39, a notched concave portion 39*c* whose rear side and lower side are opened is provided, and oval shaped engagement holes 39*d* are provided in an up/down direction in both left and right side wall portions of the notched concave portion 39*c*. In the drawing-in shaft 40*a* of the actuator 40, a drive pin 40*b* which protrudes to both the left and right sides is attached to a tip end portion that is loosely fitted into the notched concave portion 39*c* of the movable pawl 39, and both the end portions of the drive pin 40*b* are loosely fitted into the oval shaped engagement holes 39*d* provided in both the left and right side wall portions of the notched concave portion 39*c*. The oval shaped engagement holes 39*d* are formed so as to have such a size that when the movable pawl 39 performs a forward/backward swing movement around the support shaft 42 between an action posture where the lower end pawl portion 39*a* engages between the pawls of the ratchet wheel 38 and a non-action posture where the lower end pawl portion 39*a* rides on the outer side of the pawl of the ratchet wheel 38, the oval shaped engagement holes 39*d* do not interfere with the drive pin 40*b* at the tip end of the drawing-in shaft 40*a* which is positioned at the protrusion limit position of the actuator 40.

By operating the speed reducer equipped motor 24 so as to rotationally drive the pair of left and right driving sprocket wheels 23*a* and 23*b* in the clockwise direction in FIG. 7, the drive chains 22*a* and 22*b* are pulled from the top of the chain guide rails 34*a* and 34*b*, and pushed upward vertically through the lower side of the drive chains 22*a* and 22*b*. At this time, the inner roller guide plate 32 of the chain guide means 29*a* and 29*b* enters between the inner link plates 25*b* so as to regulate the positions of the drive chains 22*a* and 22*b* leftward and rightward in the horizontal direction, and simultaneously, between the linear guide side 32*a* of the inner link plate 25*b* and the linear guide side 33*a* of the outer roller guide plate 33, the rollers 27 of the drive chains 22*a* and 22*b* are sandwiched in the forward/backward direction thereof, with the result that the drive chains 22*a* and 22*b* are raised vertically upward from the upper end of the chain guide means 29*a* and 29*b* while keeping the linear state. Although by the pushing up action of the pair of left and right drive chains 22*a* and 22*b*, the workpiece support base 3 is moved upward, since the workpiece support base 3 is supported by the parallel link mechanism 2 such that the workpiece support base 3 can only be raised and lowered in parallel while keeping the horizontal posture, the workpiece support base 3 in which the two left and right parts of the rear end portion thereof are pushed upward by the pair of left and right drive chains 22*a* and 22*b* is consequently moved upward in parallel while keeping the horizontal posture.

Figure 9B:
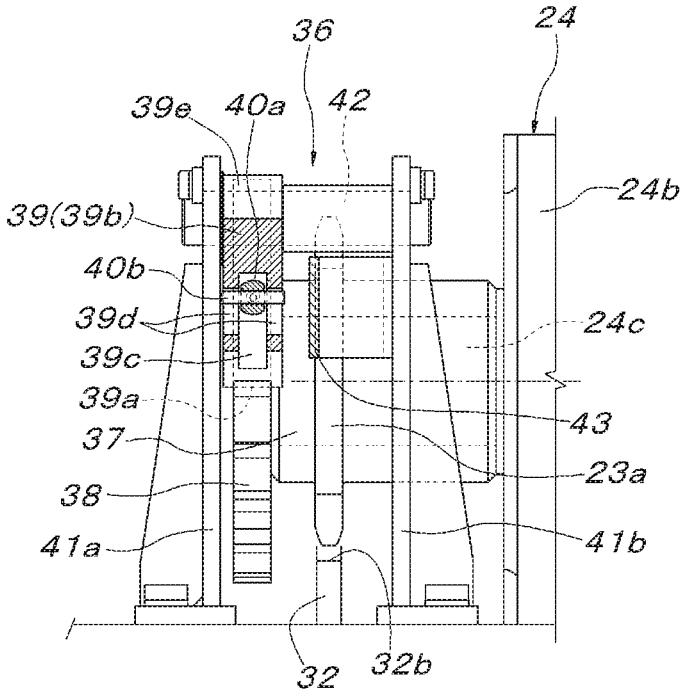
FIG. 9B is a cross-sectional view taken along line X-X of FIG. 9A.

When the workpiece support base 3 is moved upward as described above, the ratchet wheel 38 which is rotated together with the driving sprocket wheel 23*a* is rotated in the clockwise direction in FIG. 9, and as described previously, the movable pawl 39 performs the forward/backward swing movement around the support shaft 42 against gravity acting on the wide width shaped part 39*b*. However, due to the size of the oval shaped engagement holes 39*d* of the movable pawl 39 described previously, even when the drawing-in shaft 40*a* of the actuator 40 is left at the protrusion limit position, there is no possibility that a force is applied to the drawing-in shaft 40*a* of the actuator 40 due to the forward/backward swing movement of the movable pawl 39.

Figure 10A:
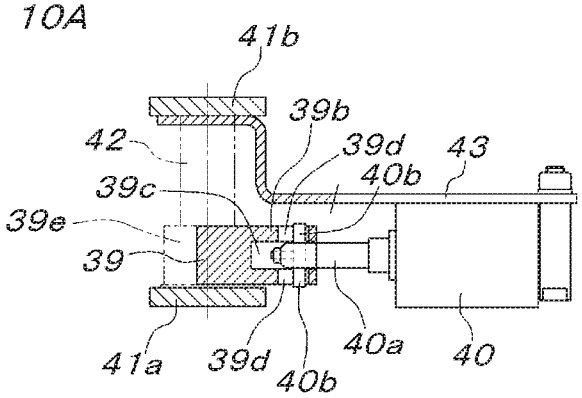
FIG. 10A is a partial horizontal cross-sectional plan view of FIG. 9A.
Figure 10B:
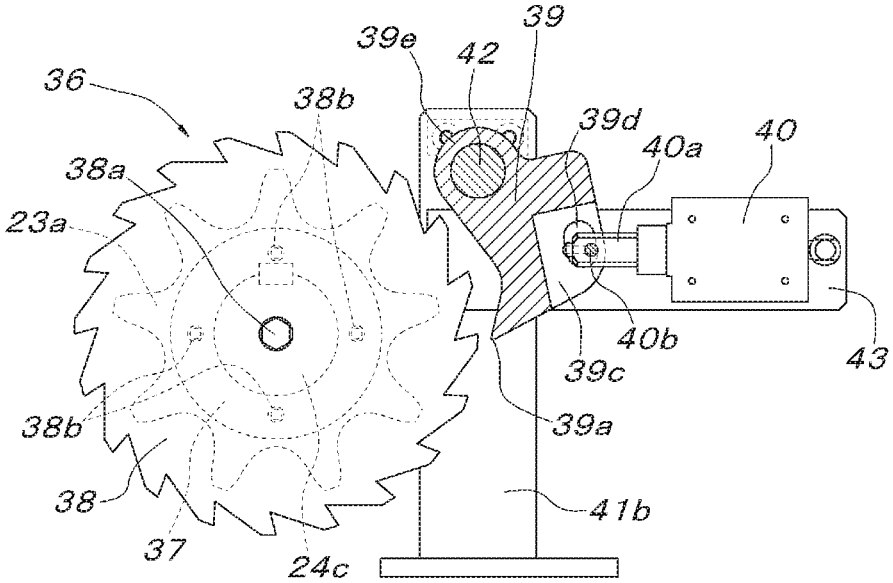
FIG. 10B is a partial vertical cross-sectional side view showing a state where the movable pawl of FIG. 9A is switched to a retraction position.

When the raised workpiece support base 3 is lowered, as shown in FIGS. 10A and 10B, the actuator 40 is energized so as to be operated to forcibly draw in the drawing-in shaft 40*a*, and, via the drive pin 40*b* at the tip end thereof and the oval shaped engagement holes 39*d* on the side of the movable pawl 39, the movable pawl 39 is forcibly made to swing forward around the support shaft 42 against gravity acting on the wide width shaped part 39*b*, and thus the movable pawl 39 is switched to the non-action state where the lower end pawl portion 39*a* does not interfere with the pawls of the ratchet wheel 38. Consequently, since the driving sprocket wheel 23*a* integrated with the ratchet wheel 38 can be rotated in the counterclockwise direction in the state shown in FIG. 7, the speed reducer equipped motor 24 is operated to make the pair of left and right driving sprocket wheels 23*a* and 23*b* rotationally driven in the counterclockwise direction in FIG. 7, and thus the drive chains 22*a* and 22*b* supporting the workpiece support base 3 are lowered. At this time, the drive chains 22*a* and 22*b* are guided by the inner roller guide plates 32 and the outer roller guide plates 33 of the chain guide means 29*a* and 29*b*, turned in a range of approximately 90 degrees around the driving sprocket wheels 23*a* and 23*b* from a vertical path section supporting the workpiece support base 3, guided onto the chain guide rails 34*a* and 34*b* through the lower side of the driving sprocket wheels 23*a* and 23*b*, and moved horizontally forward on the chain guide rails 34*a* and 34*b*.

Although in the above description, when the workpiece support base 3 is moved upward, the movable pawl 39 is engaged and disengaged with respect to the pawls of the ratchet wheel 38 without operating the actuator 40, when the speed reducer equipped motor 24 is operated so as to make the workpiece support base 3 perform the raising/lowering movement, the actuator 40 may be constantly energized so as to be operated, and thus the movable pawl 39 may be switched to the non-action state where the movable pawl 39 is disengaged from the pawls of the ratchet wheel 38. In any case, the actuator 40 is controlled such that, when the raising/lowering movement of the workpiece support base 3 by the operation of the speed reducer equipped motor 24 is completed, a state where the movable pawl 39 can engage with the pawls of the ratchet wheel 38 by gravity, that is, a state where the drawing-in shaft 40*a* is returned to the protrusion limit position without energizing the actuator 40, is achieved.

When, as described above, the speed reducer equipped motor 24 is operated so as to raise and lower the workpiece support base 3, and the workpiece support base 3 reaches a predetermined height, the energization of the motor main body 24*a* of the speed reducer equipped motor 24 is interrupted such that the drive of the driving sprocket wheels 23*a* and 23*b* is stopped. The workpiece support base 3 reaching the predetermined height is then supported by the vertically linear path section 22X of the pair of left and right drive chains 22*a* and 22*b* extending from the driving sprocket wheels 23*a* and 23*b* to the workpiece support base 3. When, after the workpiece support base 3 is driven to be raised or lowered to the intended height, the energization of the speed reducer equipped motor 24 is interrupted, the electromagnetic brake included in the speed reducer equipped motor 24 is operated, braking is applied to the output shafts 24*c* and 24*d* and the driving sprocket wheels 23*a* and 23*b* are locked. Therefore, the workpiece support base 3 is prevented from being unexpectedly lowered from the predetermined height, as a result of idling of the driving sprocket wheels 23*a* and 23*b* in the direction in which the workpiece support base 3 is lowered (the counterclockwise direction in FIG. 7) due to the fact that the drive chains 22*a* and 22*b* receive gravity on the side of the workpiece support base 3.

However, even if an abnormal event is encountered in which the electromagnetic brake included in the speed reducer equipped motor 24 does not normally operate due to failure and therefore the workpiece support base 3 is unexpectedly lowered, when the workpiece support base 3 is not driven by the speed reducer equipped motor 24 so as to raise or lower the workpiece support base 3, the movable pawl 39 is in a state where the movable pawl 39 engages with the pawls of the ratchet wheel 38 by gravity as described above. Therefore, the rotation (the rotation in the counterclockwise direction in FIG. 7) of the driving sprocket wheel 23*a* when the workpiece support base 3 is lowered is instantaneously blocked by the engagement of the movable pawl 39 with the pawls of the ratchet wheel 38, with the result that it is possible to prevent abnormal lowering of the workpiece support base 3, that is, an accidental drop.

Although in the embodiment described above, in the configuration in which the workpiece support base 3 is driven by the pair of left and right drive chains 22*a* and 22*b* to be raised and lowered, only in the driving sprocket wheel 23*a* driving the drive chain 22*a* on one side, the anti-drop safety mechanism 36 including the ratchet wheel 38, the movable pawl 39 and the actuator 40 is additionally provided, it is assumed that in this configuration, a load on the side of the dropping workpiece support base 3 can be safely received with one ratchet wheel 38 and one movable pawl 39, in a case where the receiving strength of the ratchet wheel 38 and movable pawl 39 is insufficient, it suffices to additionally provide the anti-drop safety mechanism 36 in the driving sprocket wheels 23*a* and 23*b* each driving the pair of left and right drive chains 22*a* and 22*b*. Also, in the embodiment described above, the extending direction in which the drive chains 22*a* and 22*b* are extended horizontally from the lower side of the driving sprocket wheels 23*a* and 23*b* is set to the side on which the parallel link mechanism 2 supporting the workpiece support base 3 is present, and in this case, the horizontally extending part of the drive chains 22*a* and 22*b* can be positioned not on the inner side of the pair of left and right crosslinks 4A and 4B in the parallel link mechanism 2 but on the outer side thereof or can be positioned on the lower side of the crosslinks 4A and 4B. As a matter of course, the extending direction in which the drive chains 22*a* and 22*b* are extended horizontally from the lower side of the driving sprocket wheels 23*a* and 23*b* may be set to a side opposite to the side on which the parallel link mechanism 2 supporting the workpiece support base 3 is present.

Furthermore, in a case where the pair of left and right anti-drop safety mechanisms 36 are provided as described above, the attachment phases of the mutually same ratchet wheels 38 in the respective anti-drop safety mechanisms 36 to the driving sprocket wheels 23*a* and 23*b* can be displaced only by a half pitch of the pawls, or in a case where, as in the embodiment described above, one anti-drop safety mechanism 36 is provided, the mutually same two ratchet wheels 38 can be attached to the driving sprocket wheel 23*a* such that the attachment phases to the driving sprocket wheel 23*a* are displaced from each other only by a half pitch of the pawls, and the two movable pawls 39 which engage and disengage with respect to the respective ratchet wheels 38 can be concentrically and pivotally supported, for example, with the common support shaft 42. According to these configurations, it is possible to halve the drop distance of the workpiece support base 3 until the workpiece support base 3 which drops as a result of the driving sprocket wheels 23*a* and 23*b* becoming free is received by the engagement of the movable pawl 39 with the ratchet wheel 38.

Figure 11A:
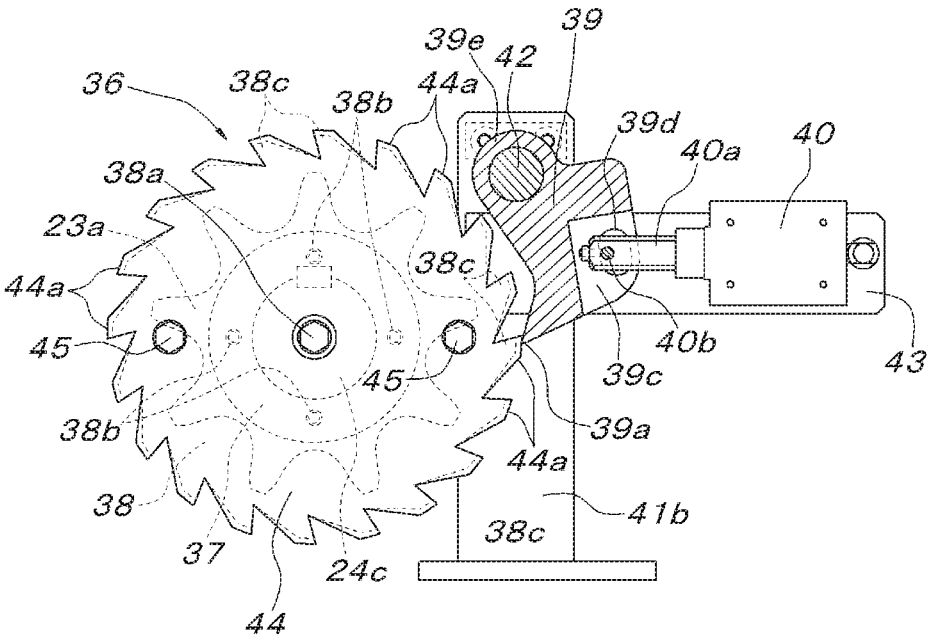
FIG. 11A is a partial cutout side view of a main part showing another embodiment of the present invention.
Figure 11B:
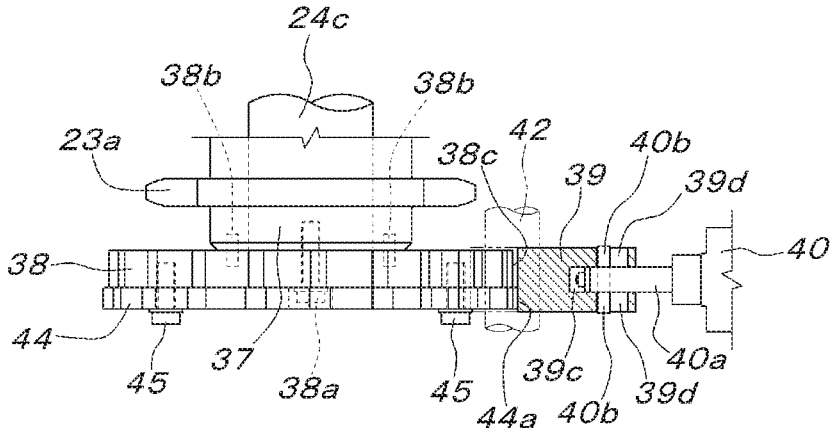
FIG. 11B is a partial cutout plan view of the same main part.

FIGS. 11A and 11B show another embodiment of the present invention, and as shown in the figures, in the ratchet wheel 38 described above, a second ratchet wheel 44 which is rotated integrally with the ratchet wheel 38, which has the same number of pawls and which is made of a resin such as an MC nylon can be provided concentrically and side by side. The second ratchet wheel 44 includes pawls 44*a* which are tall in height such that the engagement of the movable pawl 39 between the pawls 38*c* of the ratchet wheel 38 is allowed but when the movable pawl 39 rides on the pawls 38*c* of the ratchet wheel 38 so as to pass through them, the movable pawl 39 is floated up from the pawls 38*c* of the ratchet wheel 38. In the figures, in a state where the second ratchet wheel 44 is concentrically abutted against the outer side of the ratchet wheel 38 which is attached to the boss portion 37 of the driving sprocket wheel 23*a* with one bolt 38*a* and a plurality of the anti-rotation pins 38*b*, the second ratchet wheel 44 is adhered to the ratchet wheel 38 with a plurality of bolts 45 in the circumferential direction so as to be fixed thereto. In this case, as shown in the figures, in the center portion of the second ratchet wheel 44, a through hole into which the head portion of the attachment bolt 38*a* in the ratchet wheel 38 is fitted may be provided or a counterbored hole into which the head portion of the attachment bolt 38*a* is fitted may be provided in the center portion of the ratchet wheel 38. As a matter of course, the ratchet wheel 38 and the second ratchet wheel 44 may be integrated with an appropriate means so as to be attached to the boss portion 37 of the driving sprocket wheel 23*a*.

According to another embodiment described above, when, in a state where the movable pawl 39 can engage with the pawls 38*c* of the ratchet wheel 38 by gravity, the driving sprocket wheels 23*a* and 23*b* are rotationally driven in such a direction (the clockwise direction in FIG. 11A) that the workpiece support base 3 is pushed upward by the drive chains 22*a* and 22*b*, the movable pawl 39 swings around the support shaft 42 while making sliding contact with the pawl 44*a* (the pawl 44*a* made of the resin) whose height is the higher of the pawl 38*c* of the ratchet wheel 38 and the pawl 44*a* of the second ratchet wheel 44. Therefore, the generation of intermittent noise, as in the case where the second ratchet wheel 44 is not present, when the movable pawl 39 made of metal swings around the support shaft 42 while making sliding contact with the pawl 38*c* of the ratchet wheel 38 made of metal, can be significantly suppressed. As a matter of course, when the movable pawl 39 is forcibly switched by the actuator 40 to the action position in order to block the dropping of the workpiece support base 3 when the driving sprocket wheel 23*a* becomes free, it is possible to make the movable pawl 39 reliably engaged between the pawls 38*c* of the ratchet wheel 38, without being influenced by the presence of the pawls 44*a* of the second ratchet wheel 44, to block the dropping of the workpiece support base 3.

The vertically movable workpiece support device of the present invention can be utilized as a highly safe workpiece support base in which it is possible to prevent an accidental drop of the workpiece support base when a driving sprocket wheel that drives a drive chain (push chain) raising and lowering the workpiece support base is unexpectedly brought into a free state due to, for example, a failure on the side of a motor.

What is claimed is:

1. A vertically movable workpiece support device, comprising:

a raising/lowering drive means that drives a workpiece support base supported so as to be parallelly and vertically movable to raise and lower the workpiece support base;

the raising/lowering drive means having a drive chain that is bendable to only one side and a driving sprocket wheel driven by a motor that engages with the drive chain, in which the drive chain supports the workpiece support base in a vertically linear path section, where the drive chain is extended from one end portion coupled to the workpiece support base to a portion engaging with the driving sprocket wheel and in which a part of the drive chain on a free end side from the driving sprocket wheel is extended horizontally through a lower side of the driving sprocket wheel;

a ratchet wheel having a larger diameter than an outer diameter of the driving sprocket wheel is concentrically attached to an outer side of the driving sprocket wheel, a pair of left and right bearing members are provided side by side, on a side on which the free end side of the drive chain is horizontally extended with respect to the driving sprocket wheel, so as to sandwich a horizontally extending path section of the drive chain;

a movable pawl which engages with the ratchet wheel so as to block rotation of the ratchet wheel caused by a movement of the drive chain when the workpiece support base is lowered is pivotally supported between the pair of left and right bearing members;

an actuator operable to switch the movable pawl to a non-action position with respect to the ratchet wheel;

an upper end portion of the movable pawl is pivotally supported at a height of a circumferential edge of the ratchet wheel, an expanded part of the movable pawl between the upper end portion and a lower end pawl portion is expanded to a side away from the ratchet wheel, and gravity acting on the expanded part causes a rotation force on the movable pawl in such a direction that the lower end pawl portion biased toward and engages with a circumferential edge of the ratchet wheel;

the expanded part of the movable pawl has a notched concave portion having a rear side and lower side which are open on a side opposite to the ratchet wheel, engagement holes are provided in both left and right side wall portions of the notched concave portion, a tip end of a drawing-in shaft of the actuator is disposed in the concave portion, a tip end of a drawing-in shaft of the actuator is disposed in the notched concave portion, and both end portions of a drive pin attached to the tip end of the drawing-in shaft are fitted into the engagement holes, and each engagement hole has a shape and size to allow certain movement of the drive pin therein such that an engagement/disengagement swing movement of the movable pawl caused by the rotation of the ratchet wheel when the workpiece support base is raised is not transmitted to the drive in, and when the drawing-in shaft of the actuator is made to perform a drawing-in operation, the movable pawl is held in a state where the movable pawl is disengaged from the ratchet wheel via the dove pin and the engagement holes.

2. The vertically movable workpiece support device according to claim 1, further comprising:

the ratchet wheel having a number of pawls each having a height;

a second ratchet eel made of a resin is rotated integrally and concentrically with the ratchet wheel, and the second ratchet wheel has the same number of pawls as the ratchet wheel; and the second ratchet wheel having pawls which are taller in height than the pawls of the ratchet wheel such that an engagement of the movable pawl between the pawls of the ratchet wheel is allowed but that when the movable pawl rides over the pawls of the ratchet wheel, the movable pawl is floated up from the pawls of the ratchet wheel.

* * * * *